US005309586A

United States Patent [19]

Sies et al.

[11] Patent Number: 5,309,586

[45] Date of Patent: May 10, 1994

[54] BABY SEAT OR CARRIER BLANKET

[76] Inventors: Bunny L. Sies; Kelley F. Sies, both of 1103 N. Monroe St., Litchfield, Ill. 62056

[21] Appl. No.: 17,178

[22] Filed: Feb. 12, 1993

[51] Int. Cl.[5] ..... A47G 9/00

[52] U.S. Cl. ..... 5/482; 5/494; 5/904; 297/184.13; 297/219.12; 446/404; 446/419

[58] Field of Search ..... 5/482, 494, 497, 904; 297/184, 219, 224; 296/81, 82; 2/69; 446/71, 404, 418, 419

[56] References Cited

U.S. PATENT DOCUMENTS

| | | | |
|---|---|---|---|
| 2,994,889 | 8/1961 | Oblander | 5/904 X |
| 3,378,948 | 4/1968 | Gervaise | 5/904 X |
| 3,384,990 | 5/1968 | Romand | 446/419 |
| 3,493,228 | 2/1970 | Hicks et al. | 446/419 X |
| 4,478,453 | 10/1984 | Schutz | 297/219 |
| 4,946,221 | 8/1990 | Livingston | 297/224 X |
| 5,046,207 | 9/1991 | Chamberlain | 5/497 X |
| 5,150,945 | 9/1992 | Aupperlee et al. | 297/219 X |

FOREIGN PATENT DOCUMENTS

| | | | |
|---|---|---|---|
| 211043 | 6/1957 | Australia | 2/69 |

*Primary Examiner*—Michael F. Trettel
*Attorney, Agent, or Firm*—S. Michael Bender

[57] ABSTRACT

A new and improved blanket apparatus for fitting over a baby seat or carrier which has a top and sides includes a flexible cloth member having dimensions sufficient to fit over the top and sides of the baby seat or carrier. The flexible cloth member has an outer edge; and an elastic strip or a draw string is installed near the outer edge of the flexible cloth member, for gathering the outer edge to form an opening having a plurality of adjustable sizes. A first adjustable size of the opening is sufficiently large to fit over the top and sides of the baby seat or carrier for installing the blanket apparatus on the baby seat or carrier. A second adjustable size of the opening is sufficiently small to resin the blanket apparatus on the baby seat or carrier, by preventing the blanket apparatus from slipping over the sides once the blanket apparatus has been installed. The blanket apparatus of the invention can also include side openings near the outer edge of the flexible member to permit passage of handles of a car seat or carrier through the side openings. Also, a sound generating assembly can be installed on the flexible cloth member.

6 Claims, 4 Drawing Sheets

BABY SEAT OR CARRIER BLANKET

BACKGROUND OF THE INVENTION

1. Field of the Invention

The present invention relates generally to baby blankets, and more particularly, to baby blankets especially adapted to be used with baby car seats and baby carriers.

2. Description of the Prior Art

Blankets especially designed for babies and infants are well known in the art. One type of baby blanket has special features that adapt it to be used with a car seat. For example, U.S. Pat. No. 4,993,090 of Ranalli discloses a baby blanket especially designed to be used with a baby car seat, wherein the blanket includes a plurality of apertures through which restraining members of the automobile seat harness can be passed, thus enabling the harness to be fastened tightly around the child. Then the blanket can be wrapped around the child and the harness.

Another type of baby blanket has features designed to assure that the blanket stays with the baby and does not fall off the baby as the baby tosses and turns. For example, U.S. Pat. No. 3,477,065 of Hoover discloses a blanket especially designed for being wrapped around a baby. U.S. Pat. No. 3,962,738 of Mendito discloses a blanket which employs a draw string to draw in the blanket more snugly around an infant. U.S. Pat. No. 4,172,300 of Miller discloses a baby blanket which has a zippered pouch in which the baby is placed and zippered in. U.S. Pat. No. 5,058,226 of Crosby discloses a car seat blanket for an infant, wherein a front panel and a back panel together form a two-legged pouch for a baby's legs and body.

A serious problem associated with baby blankets used with car seats is not addressed by the prior art disclosed above. There are no disclosed baby blanket features which are designed to attach the baby blanket to the car seat itself. Thus, if the car seat is removed from the car, and the baby is not present on the seat, the baby blanket is not prevented from separating from the car seat by the wind on a windy day. Another problem associated with baby blankets used with car seats is the bunching up and lumpiness that can be formed by a baby blanket which is used on the car seat. Nothing keeps the baby blanket taut and smooth on the car seat.

Thus, while the foregoing body of prior art indicates it to be well known to provide special blankets designed to fit snugly around a baby, and it is well known to have a baby blanket that is especially designed to be used with a car seat, none of the prior art described above teaches or suggests features for connecting the baby blanket to a baby car seat or baby carrier so that the baby blanket is prevented from being separated from the seat or carrier when the baby is not present in the seat or carrier. Moreover, the prior art does not disclose a baby blanket that is kept taut and smooth on a car seat or carrier.

The foregoing disadvantages are overcome by the unique blanket apparatus for a baby seat or carrier of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved blanket apparatus for fitting over a baby seat or carrier having a top and sides. The blanket apparatus of the invention includes a flexible cloth member having dimensions sufficient to fit over the top and sides of the baby seat or carrier. The flexible member has an outer edge; and an elastic strip or a draw string is installed near the outer edge of the flexible cloth member, for gathering the outer edge to form an opening having a plurality of adjustable sizes. A first adjustable size of the opening is sufficiently large to fit over the top and sides of the baby seat or carrier for installing the blanket apparatus on the baby seat or carrier. A second adjustable size of the opening is sufficiently small to retain the blanket apparatus on the baby seat or carrier, by preventing the blanket apparatus from slipping over the sides of the seat or carrier once the blanket apparatus has been installed. The blanket apparatus of the invention can also include side openings near the outer edge of the flexible member to permit passage of handles of a car seat or carrier through the side openings.

Also, a sound generating assembly can be installed on the flexible cloth member. The sound generating assembly can generate sound when the flexible member is moved. The sound generating assembly may include a rolling ball in a walled chamber. The walled chamber may include vents for facilitating escape of sound and may include chimes that are struck by the rolling ball.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved blanket apparatus for a baby seat or carrier which has all of the advantages of the prior art and none of the disadvantages.

It is another object of the present invention to provide a new and improved blanket apparatus for a baby seat or carrier which may be easily and efficiently manufactured and marketed.

It is a further object of the present invention to provide a new and improved blanket apparatus for a baby seat or carrier which is of durable and reliable construction.

An even further object of the present invention is to provide a new and improved blanket apparatus for a baby seat or carrier which is susceptible of a low cost of manufacture with regard to both materials and labor, and which accordingly is then susceptible of low prices of sale to the consuming public, thereby making such blanket apparatus for a baby seat or carrier available to the buying public.

Still yet a further object of the present invention is to provide a new and improved blanket apparatus for a baby seat or carrier that has a provision for connecting the blanket to a baby car seat or baby carrier.

Still another object of the present invention is to provide a new and improved blanket apparatus for a baby seat or carrier that prevents the blanket from separating from the car seat or carrier when the car seat or carrier is removed from the car and a baby is not present on the seat or carrier.

Yet another object of the present invention is to provide a new and improved blanket apparatus for a baby seat or carrier that has features for attaching the blanket to the car seat or carrier itself.

Even another object of the present invention is to provide a new and improved blanket apparatus for a baby seat or carrier that keeps the baby blanket taut and smooth on the car seat or carrier.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an partial cross-sectional view of a third embodiment of the blanket apparatus for a baby seat or carrier of the invention which includes a sound generating assembly to amuse the baby, wherein FIG. 5 is the view in the circled area of FIG. 4.

DESCRIPTION OF THE PREFERRED EMBODIMENT

With reference to the drawings, a new and improved blanket apparatus for a baby seat or carrier embodying the principles and concepts of the present invention will be described.

Figure 1:
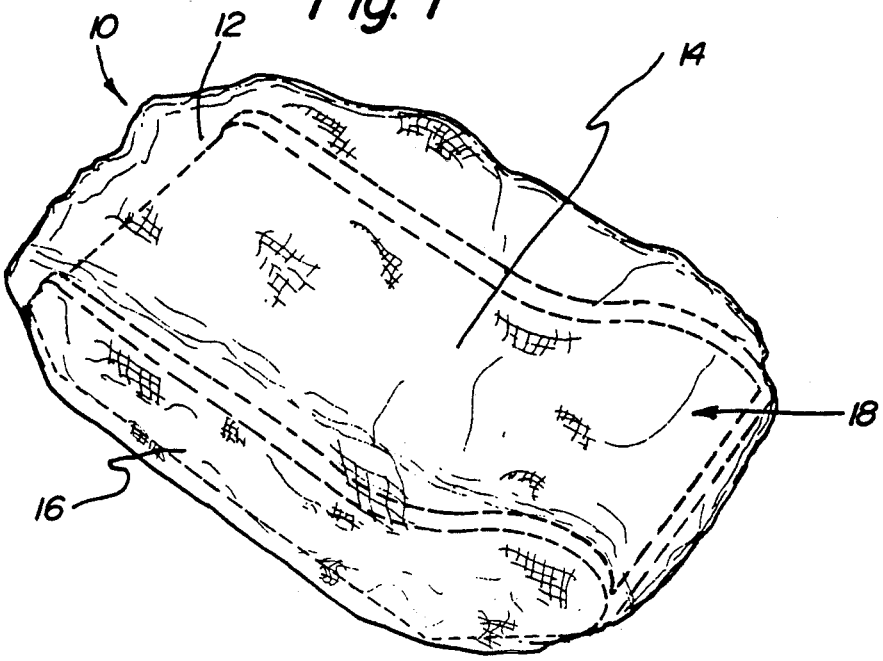
FIG. 1 is a perspective view showing a first preferred embodiment of the blanket apparatus for a baby seat or carrier of the invention attached to a baby carrier shown in phantom view.
Figure 2:
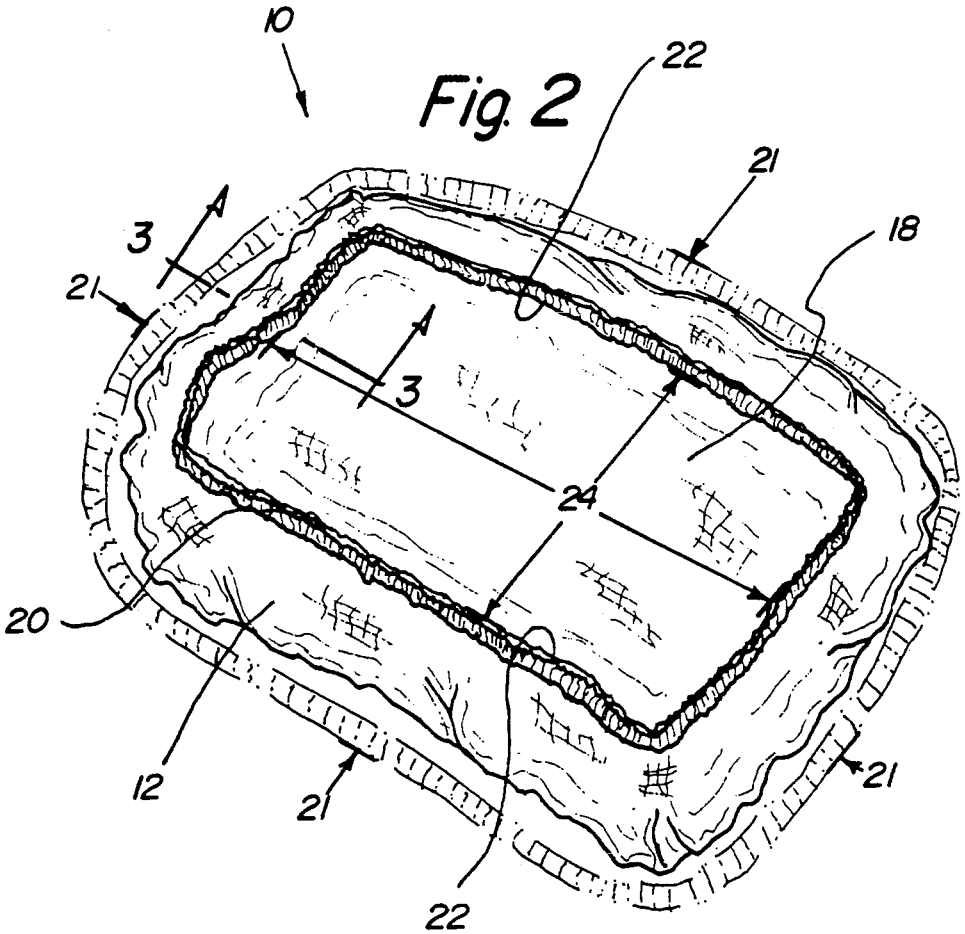
FIG. 2 is a bottom view of the embodiment of the blanket apparatus for a baby seat or carrier of the invention shown in FIG. 1.
Figure 3:
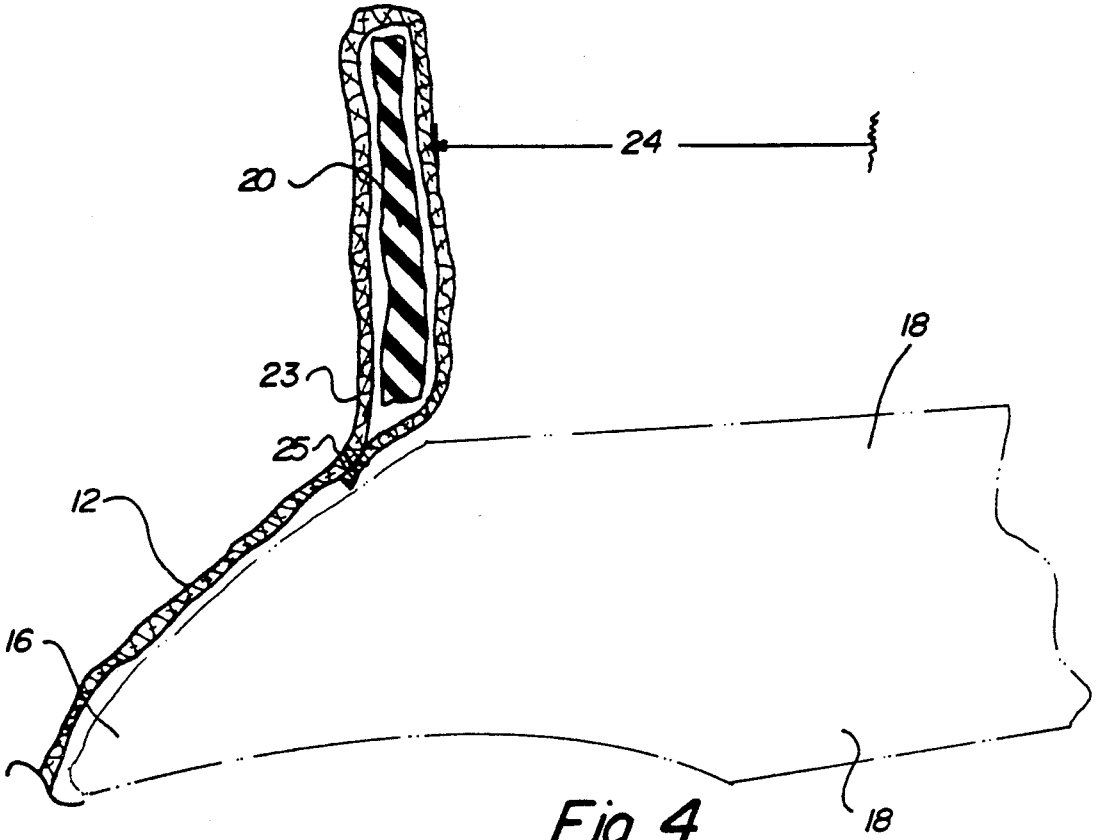
FIG. 3 is an enlarged, partial cross-sectional view of the embodiment of the blanket apparatus for a baby seat or carrier of the invention shown in FIG. 2 taken along the line 3—3 in FIG. 2.

Turning initially to FIGS. 1–3, there is shown a first exemplary embodiment of the blanket apparatus for a baby seat or carrier of the invention generally designated by reference numeral 10. In the first embodiment shown, the blanket apparatus 10 of the invention includes a flexible cloth member 12 which has dimensions sufficient to fit over the top 14 and sides 16 of the baby carrier 18 (which could also be a baby seat such as a car seat). The flexible cloth member 12 has an outer edge. An elastic strip 20 is installed near the outer edge of the flexible member 12, for gathering the outer edge to form an opening 22 having a plurality of adjustable sizes. More specifically, as shown in FIG. 3, an elastic strip 20 is jacketed by the outer edge 23 of the flexible member 12, and the outer edge of the flexible member 12 is sewn by threads 25 to encase the flexible strip 20.

A first adjustable size 21 (shown in dotted outline in FIG. 2) of the opening 22 is sufficiently large to fit over the top 14 and sides 16 of the baby carrier 18 for installing the blanket apparatus on the baby seat or carrier. In addition, the opening 22 has a second adjustable size 24 which is sufficiently small to hold the blanket apparatus 10 onto the baby carrier 18, by preventing the blanket apparatus 10 from slipping over the sides 16 of the carrier 18, once the blanket apparatus 10 has been installed on the carrier 18.

Figure 4:
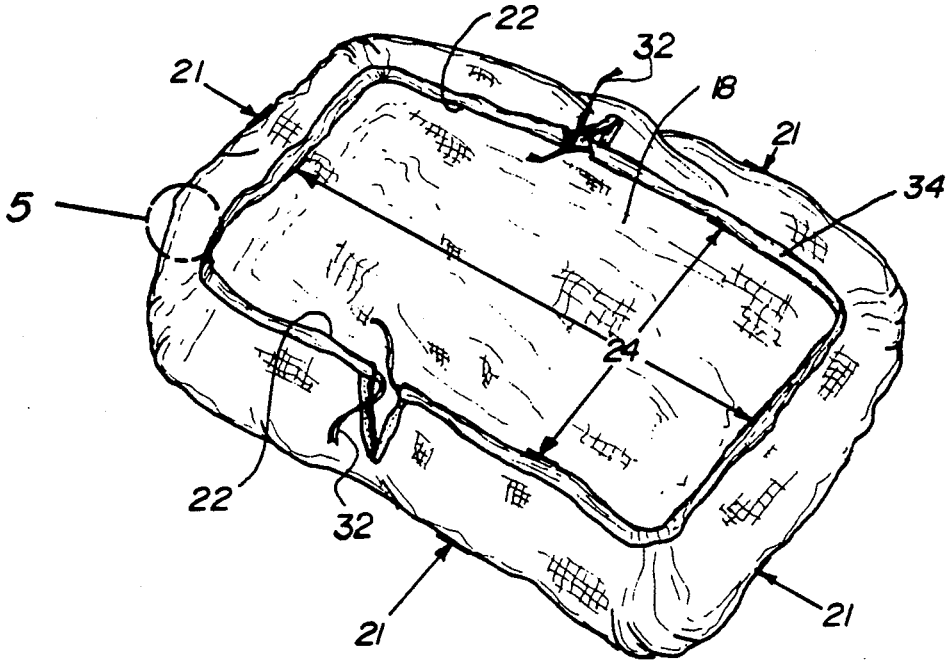
FIG. 4 is a bottom perspective view of a second embodiment of the blanket apparatus for a baby seat or carrier of the invention.

Turning to FIG. 4, reference numerals are shown that correspond to like reference numerals that designate like elements shown in the other figures. In addition, FIG. 4 shows a second embodiment of the blanket apparatus 10 of the invention in which the outer edge of the flexible member 12 includes side openings 30 for permitting passage of handles (not shown) of a handle-bearing car seat or handle-bearing carrier therethrough. Moreover, as shown in FIG. 4, the opening 22 is adjusted to the small size 24 which has been accomplished by pulling draw strings 32 that are located in channels 34 made from cloth material.

Figure 5:
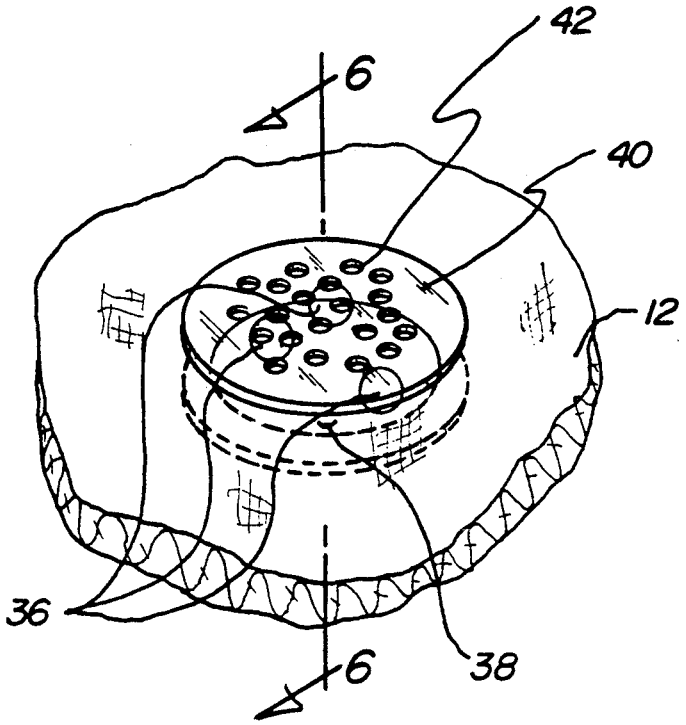
Figure 6:
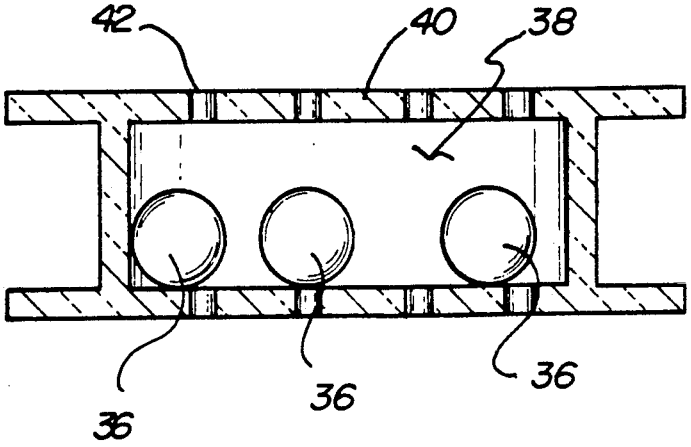
FIG. 6 is a cross-sectional view of the sound generating assembly shown in FIG. 5 taken along the line 6—6 in FIG. 5.
Figure 7:
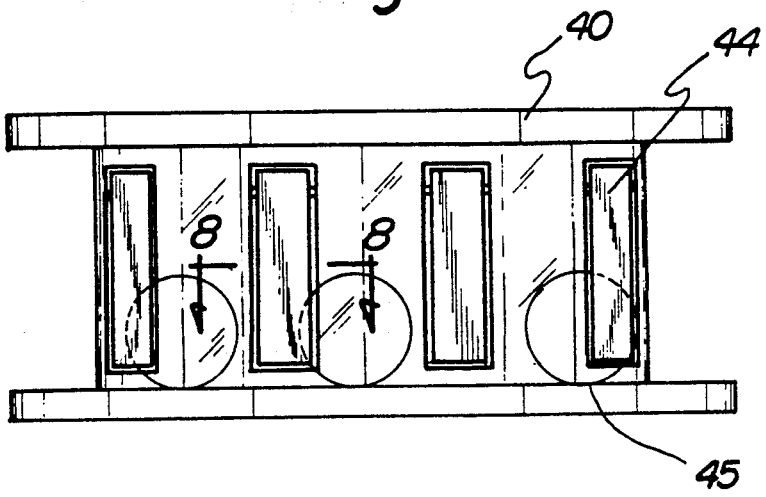
FIG. 7 is a side of an alternate sound generating assembly of the invention.
Figure 8:
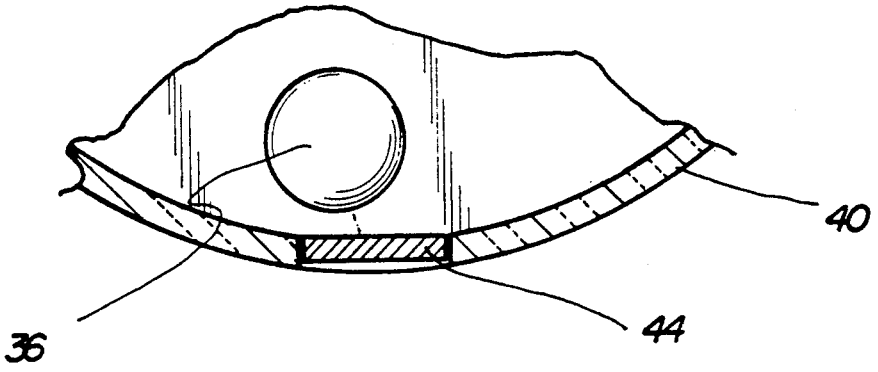
FIG. 8 is a partial cross-sectional view of the alternate sound generating assembly of the invention shown in FIG. 7 taken along the line 8—8 in FIG. 7.

Turning to FIGS. 5–8, members of a third class of embodiments of the blanket apparatus 10 of the invention are shown. Sound can be a very entertaining and fascinating characteristic for a baby. Pleasant sounds can also be soothing and relaxing to a baby. In FIG. 5, the flexible member 12 includes means for generating sound as the flexible member 12 is moved. More specifically, flexible member 12 includes a plurality of rolling balls 36 contained in a walled chamber 38. The walled chamber 38 includes wall 40 having vents 42 for facilitating escape of sound from the chamber 38. As shown in FIGS. 7 and 8, the walled chamber 38 includes chimes 44 in wall panels 45 that are struck by the rolling balls 36 when the flexible member 12 is moved.

Movement of the rolling balls 36 in the sound producing chamber 38 can be due to a number of causes. The baby itself can move, causing the flexible member 12 to move. Alternately, the movement to the flexible member 12 can be caused by movement of an automobile along bumps in a road. Movement of the flexible member 12 can also be caused by a care giver tugging on the flexible member 12 in order to initiate the sounds.

The flexible member 12 can be made from a wide variety of inexpensive materials currently being used for baby blankets or baby clothes. The size of the flexible member 12 can be carefully selected so that when the blanket apparatus 10 of the invention is installed on a baby seat or carrier, the top surface of the flexible member 12 is taut and smooth, whereby lumps and folds are precluded from being present under the baby when the baby is placed on the seat or carrier.

Alternatively, the size of the flexible member 12 may be selected so that, even when the blanket apparatus 10 of the invention is installed on a baby seat or carrier, the top surface of the flexible member 12 has sufficient slack so that the slack can be folded over to cover the baby so that the baby is encased in the flexible member 12 like a pea in a pod.

It is apparent from the above that the present invention accomplishes all of the objects set forth by providing a new and improved blanket apparatus that is low in cost, relatively simple in design and operation, and which may advantageously be used for carrying a baby on a baby seat or baby carrier.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved blanket apparatus for fitting over a baby seat or carrier having a top and sides, comprising:

a flexible member having dimensions sufficient to fit over the top and sides of the baby seat or carrier and having an outer edge; and means, installed near said outer edge of said flexible member, for gathering said outer edge to form an opening having a plurality of adjustable sizes, wherein a first adjustable size of said opening is sufficiently large to fit over the top and sides of the baby seat or carrier for installing the blanket apparatus on the baby seat or carrier, and wherein a second adjustable size of said opening is sufficiently small to hold the blanket apparatus onto the baby seat or carrier, by preventing the blanket apparatus from slipping over the sides of the baby seat or carrier, once the blanket apparatus has been installed on the baby seat or carrier, the blanket apparatus described in claim 1, further comprising means, attached to said flexible member, for generating sound as said flexible member is moved, wherein said sound generating means is comprised of a rolling ball in a walled chamber, and wherein said walled chamber includes chimes that are struck by said rolling ball.

2. The blanket apparatus described in claim 1 wherein said outer edge gathering means includes an elastic strip.

3. The blanket apparatus described in claim 1 wherein said outer edge gathering means includes a channel and a draw string located in said channel.

4. The blanket apparatus described in claim 1 wherein said flexible member is a made of cloth.

5. The blanket apparatus described in claim 1 wherein said outer edge of said flexible member includes side openings for permitting passage of handles of car seats or carriers therethrough.

6. The blanket apparatus described in claim 1 wherein said walled chamber includes vents for facilitating escape of sound.

* * * * *